United States Patent [19]

Muth et al.

[11] Patent Number: 4,984,737

[45] Date of Patent: Jan. 15, 1991

[54] MOBILE SHELVING APPARATUS

[75] Inventors: James C. Muth, Eagle; James J. Slattery, North Prairie, both of Wis.

[73] Assignee: Spacesaver Corporation, Fort Atkinson, Wis.

[21] Appl. No.: 315,137

[22] Filed: Feb. 24, 1989

[51] Int. Cl.[5] ..... E01B 9/42; A47F 5/00

[52] U.S. Cl. ..... 238/281; 238/188; 105/170; 211/162; 211/151; 295/4

[58] Field of Search ..... 108/42, 43, 48, 56.1, 108/56.3; 16/45; 211/162, 151, 134, 186; 295/4; 105/238.1, 170, 169, 396, 169, 170, 218.1; 238/290, 264, 291, 268, 292, 281, 27, 306, 151, 172, 209, 175, 193, 215, 176, 187, 189, 192, 188, 190, 209, 195, 216, 198, 199, 10 R, 13

[56] References Cited

U.S. PATENT DOCUMENTS

| | | | |
|---|---|---|---|
| 1,805,421 | 5/1931 | Shahan | 238/10 R |
| 2,981,969 | 5/1961 | Fontana | 105/170 |
| 4,382,547 | 5/1983 | Phillips | 238/281 |
| 4,770,475 | 9/1988 | Peterman | 312/201 |
| 4,771,901 | 9/1988 | Griswold et al. | 211/151 |

OTHER PUBLICATIONS

Exhibit 1-Erection Instruction Booklet for a Spare Unit, 12 pages, no date.

*Primary Examiner*—Robert P. Olszewski
*Assistant Examiner*—Mark T. Le
*Attorney, Agent, or Firm*—Fuller, Ryan & Hohenfeldt, S.C.

[57] ABSTRACT

Mobile shelving apparatus comprises rails that are leveled by stacks of interlocking shims. The shims are placed under and interlock with rail support brackets at the joints in the rails. Rail spreaders used to align the rails are also leveled with and interlock with the shims. The mobile shelving apparatus includes a carriage platform supported on the rails by wheel assemblies that are assembled to the platform without fasteners. Wheels are retained to bearings by swaging portions of the wheels onto the bearing outer races. The bearing inner races are retained on respective shafts by swaging rings onto the shafts. The wheel assembly shafts are secured to the platform by swaging the ends of the shafts to the platform. The invention further comprises an upright anchor clip for joining the platform to the carriage framework that stores selected items.

19 Claims, 5 Drawing Sheets

4
4
9
23
21
49
45
53
55
61
25
17
35
31
41
47
5
19
6
17
19
54
37
51

6
3
35
29
25
53
57
61
35
31
37
6

33
27
29
29
61
59
61
73
71
28
43
41
39
41
31
31
25
34
81
69
81
83
83
73
37
69
81
63
81

31
29
25
71
41
69
63
73
27
5
37
69
73
83
59
63
73a
63a
69a

MOBILE SHELVING APPARATUS

BACKGROUND OF THE INVENTION

1. Field of the Invention

This invention pertains to mobile shelving systems, and more particularly to economical mobile shelving having modular components.

2. Description of the Prior Art

Various types of mobile storage systems have been developed for storing supplies, books, and other items. Such equipment is becoming increasingly popular because of its ability to conserve expensive building space.

A mobile storage system includes one or more wheeled carriages that travel along rails mounted in the building floor. A stationary shelving unit may be fixed in the floor at one or both ends of the rails. The carriages may have manually operated mechanical assists for moving them. Some systems include electric motors and suitable drive components for moving the carriages.

Prior mobile storage systems are typically custom designed for the particular application. The rails are imbedded in the building floor. The carriages are designed specifically to suit particular space requirements. Such parameters as rails spacing, carriage width and length, and shelving type are special for each installation.

Such systems were and continue to be entirely satisfactory for a large of number of users. However, a need has developed for mobile storage systems that are less expensive then the prior ones, and also that may be more easily installed. Some attempts have been made to fulfill that need. The resulting equipment is not entirely satisfactory, however, because some of the components remain undesirably expensive, and installation is excessively time consuming and difficult.

SUMMARY OF THE INVENTION

In accordance with the present invention, economical and modular mobile storage apparatus is provided that is easily installable in almost any desired building location. This is accomplished by apparatus that includes interlocking leveling shims that support the system rails and an inexpensive hut very sturdy carriage wheel assembly.

The rails are fabricated from properly bent, heavy gauge sheet metal. They are leveled by supporting them at proper intervals by stacks of interlocking shims. The shims are formed as generally rectangular plates of sheet metal. Each shim has several points of engagement with the adjacent shim. The uppermost shim of a stack is interlockable with a rail support bracket, thereby assuring that the shims remain in place under the rails during installation and operation.

To provide interengagement of the shims, each shim has a series of cutouts and tangs symmetrically located about longitudinal and transverse center lines. The shims are placed on top of each other turned at 180° to each other, such that the tangs of a lower shim engage the corresponding notches on the overlying shim. The rail support brackets are cut out to engage the tangs of the underlying shim, thereby tying the stack of shims, rail support brackets, and rails together.

The rails are spaced apart in parallel fashion by rail spreaders of fixed length. The spreaders have slots at their ends that fit over appropriate tabs of the respective rail support brackets. Like the rails the spreaders are supported by and leveled with an appropriate number of shims. The spreaders are manufactured with openings for engaging the tangs of the shims, so that the shims underlying the spreaders also remain in place during installation and operation.

Further in accordance with the present invention, each mobile carriage rolls along the rails on a sturdy but economical upright bearing section associated with each rail. The bearing section comprises a portion of a carriage platform, which in turn supports the storage shelves and the shelf supporting framework. Each bearing section is preferably comprised of a generally u-shaped channel. The channels of each platform are rigidly joined together by a pair of tubes, the ends of which are securely crimped into place within suitable holes in the channels. Rollingly supporting each hearing section are a pair of spaced wheel assemblies. Each wheel assembly comprises a rail contacting wheel, a bearing, a shaft, and a ring. The bearing outer race is retained in the wheel by a shoulder in one side of the wheel and by several swages formed in the opposite side of the wheel. The shaft is retained in the hearing by a shoulder that bears against one side of the bearing inner race. The ring is swaged into the shaft on the other side of the bearing inner race. The wheel assemblies are inserted into aligned slots in the side walls of the u-shaped channel. Each slot receives an end of the shaft. The ends of the shaft are then swaged over the respective channel side walls, thereby permanently and rigidly mounting the wheels to the platform. In that manner, the wheel assemblies themselves are assembled without fasteners, and the wheel assemblies are assembled to the carriage without fasteners.

It is a feature of the present invention that the shelving and supporting framework are rigidly attached to the carriage platform by upright anchor clips that also properly position the framework during assembly. A pair of upright anchor clips is used with each platform bearing section. Each upright anchor clip is formed with an upstanding return flange, such that the two anchor clips on a bearing section positively locate the shelving framework on the platform.

Other objects, aims, and advantages of the invention will become apparent upon reading the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 2:
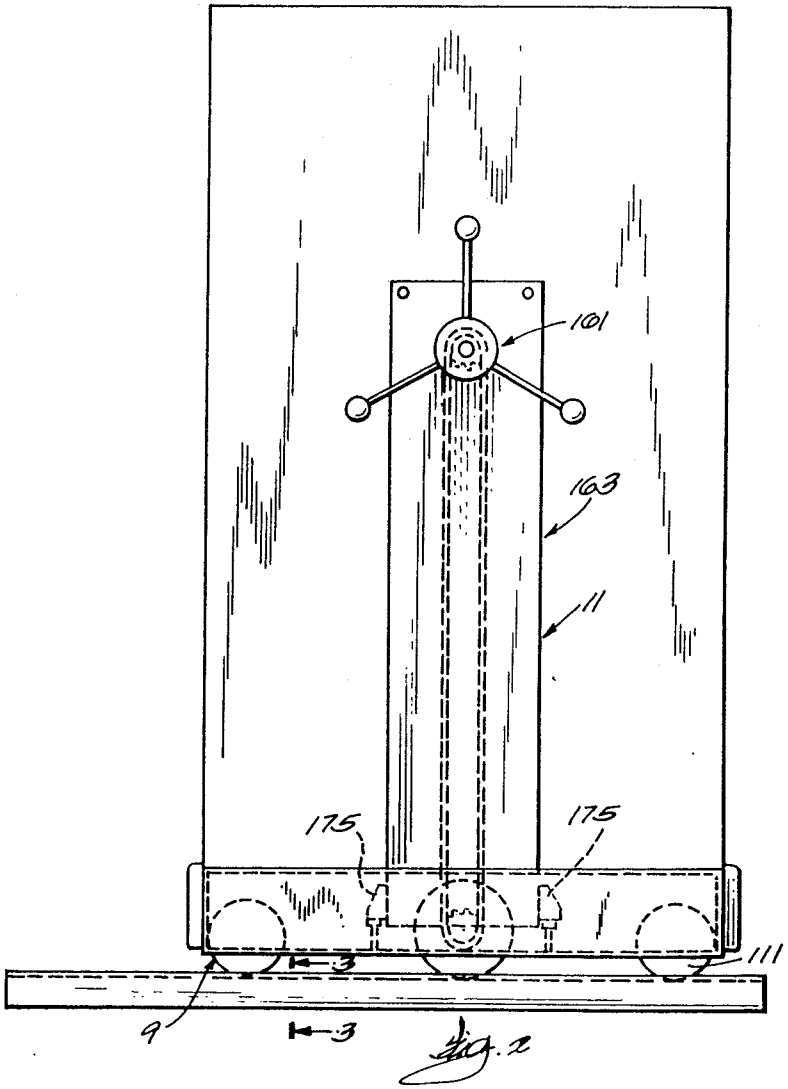
FIG. 2 is a side view of the mobile carriage of FIG. 1.
Figure 1:
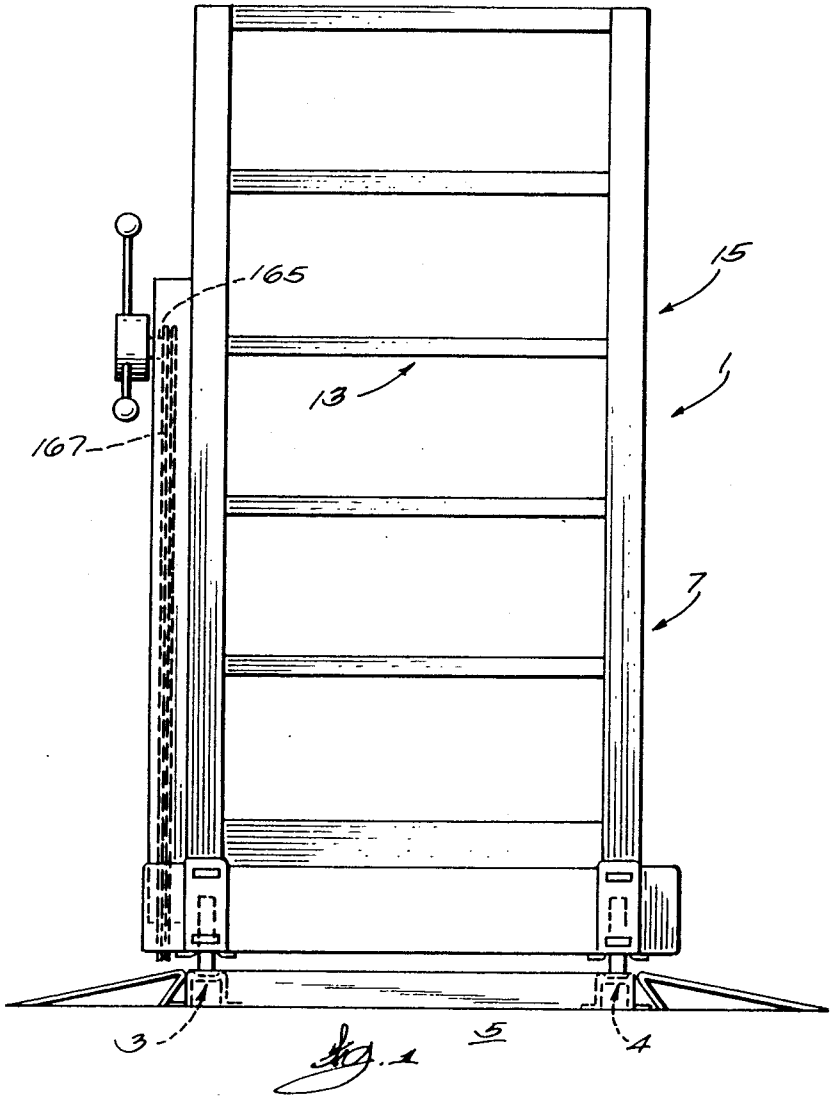
FIG. 1 is a front view of a mobile carriage according to the present invention.
Figure 3:
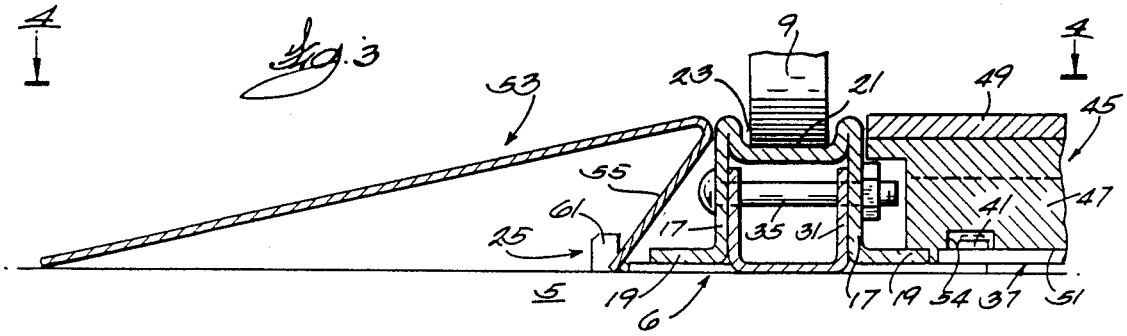
FIG. 3 is an enlarged cross-sectional view taken along lines 3—3 of FIG. 2.
Figure 4:
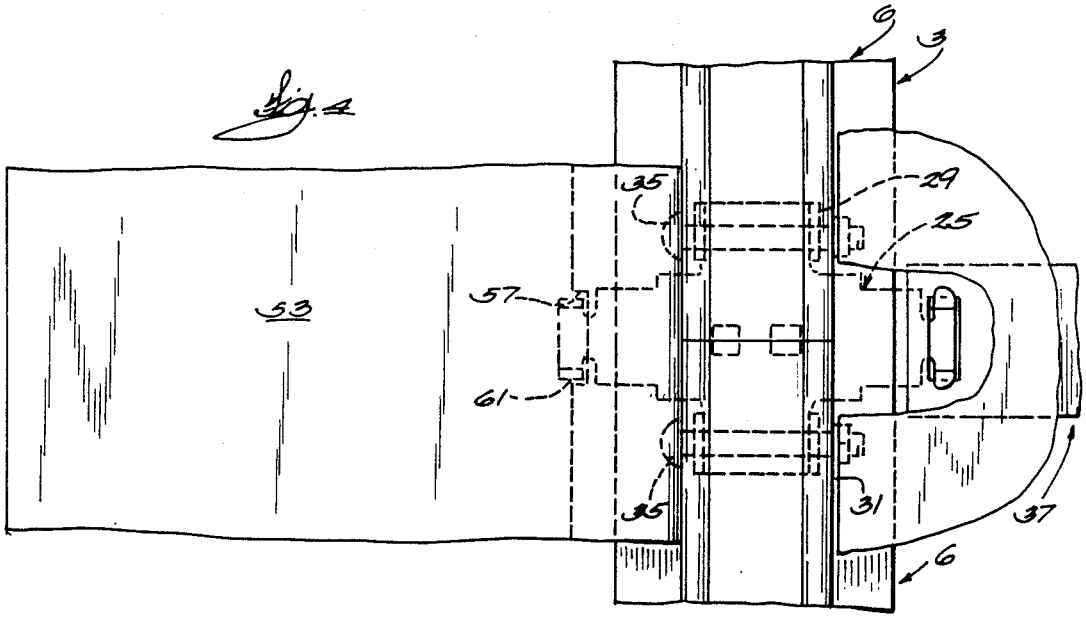
FIG. 4 is a view taken along lines 4—4 of FIG. 3.
Figure 5:
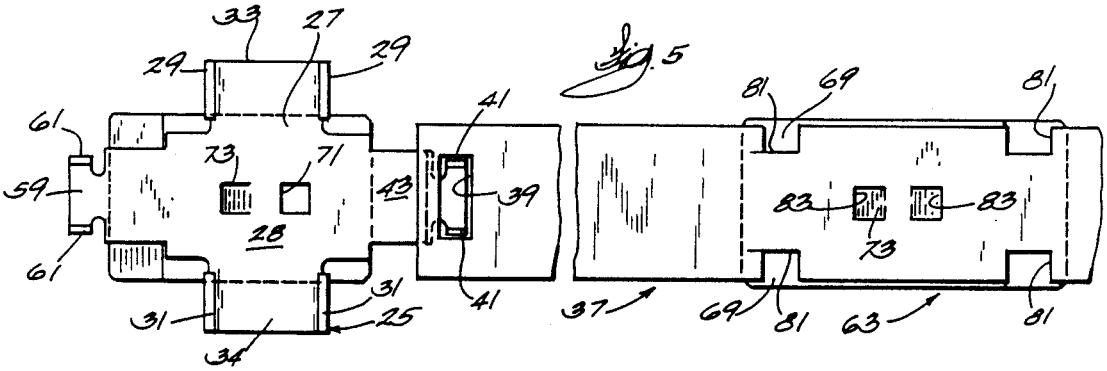
FIG. 5 is a top view of the interconnection between the rail leveling shims, rail support brackets, and rail spreaders of the present invention.

Referring to FIGS. 1 and 2, mobile storage apparatus 1 is illustrated that includes the present invention. The mobile storage apparatus is especially useful for economically and conveniently storing documents, supplies and other items in a minimum of building space.

The mobile shelving apparatus 1 comprises one or more carriages 7 supported on wheel assemblies 9 for rolling along rail sets 3 and 4 placed on a building floor. Each carriage 7 includes shelves 13 and a supporting framework 15 for storing the desired items. A manual assist 11 facilitates movement of the carriage. The particular apparatus shown has two rail sets 3 and 4, but it will be understood that the invention is not limited to a two rail set system. A stationary shelving unit, not shown, may be installed at one or both ends of the rail sets.

Looking also at FIGS. 3–6, each rail 6 of the rail sets 3 and 4 is formed with a pair of spaced vertical legs 17 that terminate at their respective lower ends in outturned feet 19. The upper ends of the legs 17 are bent over at 180°, and the two legs are joined by a horizontal section 21 that serves as a depressed track 23 for the carriage wheel assemblies 9. As many rails 6 as desired may be placed in endwise abutment along the floor 5 in each rail set.

To join adjacent rail ends, a rail support bracket 25 is used at each rail junction. Each rail support bracket 25 is comprised of a generally cruciform shaped base 27 having a central portion 28. Two pairs of legs 29 and 31 extend vertically upwardly from one pair of opposed arms 33 and 34, respectively, on the base 27. The rail side legs 17 at one end of a rail are placed over one pair of the rail support bracket legs 29 or 31. A fastener 35 passes through aligned holes in the rail and rail support bracket legs to rigidly join the two members to each other. A second rail is similarly placed over the other rail support bracket legs, and another fastener 35 joins that rail to the rail support bracket and thus to the adjacent rail.

To set and maintain an accurate spacing between the rail sets 3 and 4, rail spreaders 37 are employed. Each spreader 37 is formed as an elongated flat bar having a slot 39 in each end thereof. The slots 39 are sized to fit over a pair of tabs 41 that are joined to and extend vertically upward from arm 43 of the rail support bracket base 27. Since the rail sets 3 and 4 are fixed to the rail support brackets by the fasteners 35, the slot and tab arrangement of the spreaders and rail support brackets function to properly align the rail sets to each other.

Carpeted floor panels 45 are installed between the rail sets 3 and 4. Each floor panel 45 consists of a structural sheet 47 covered with a decorative carpeting 49. The bottom surface 41 of the structural sheet 47 rests on the rail feet 19 and on the rails spreaders 37. Appropriate cutouts 52 and 54 are machined into the structural sheets so as to provide clearance with the fasteners 35 and the rail support brackets 41. Decorative and safety enhancing ramps 53 are placed on the outboard sides of the rail sets. The ramps 53 are fabricated with respective bent-over sections 55 that have notches 57. Each notch 57 engages the arm 59 of a rail support bracket 25. Upright tabs 61 extending from the rail support bracket arms 59 assist in holding the ramps in place.

Figure 7:
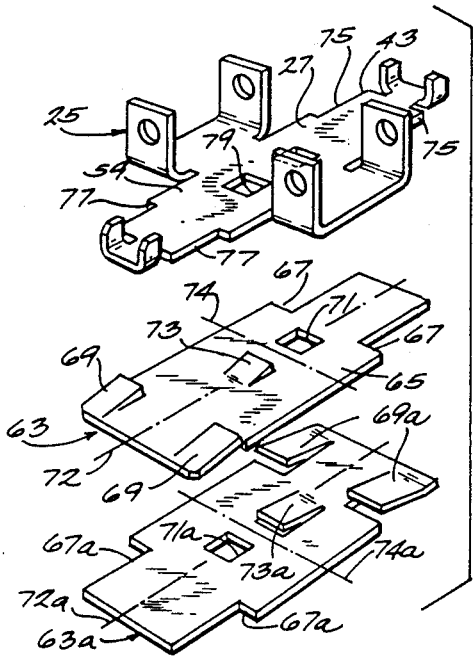
FIG. 7 is an exploded perspective view of a stack of shims and a rail support bracket according to the present invention.
Figure 9:
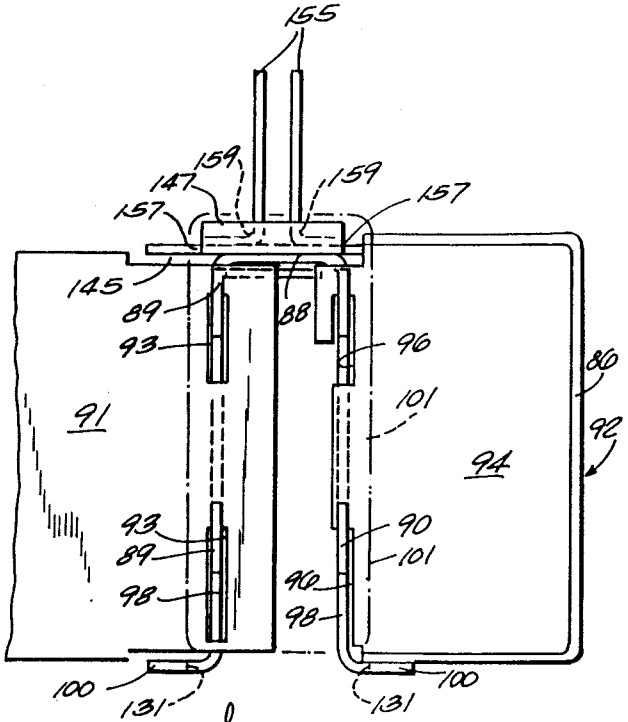
FIG. 9 is an end view of FIG. 8.
Figure 8:
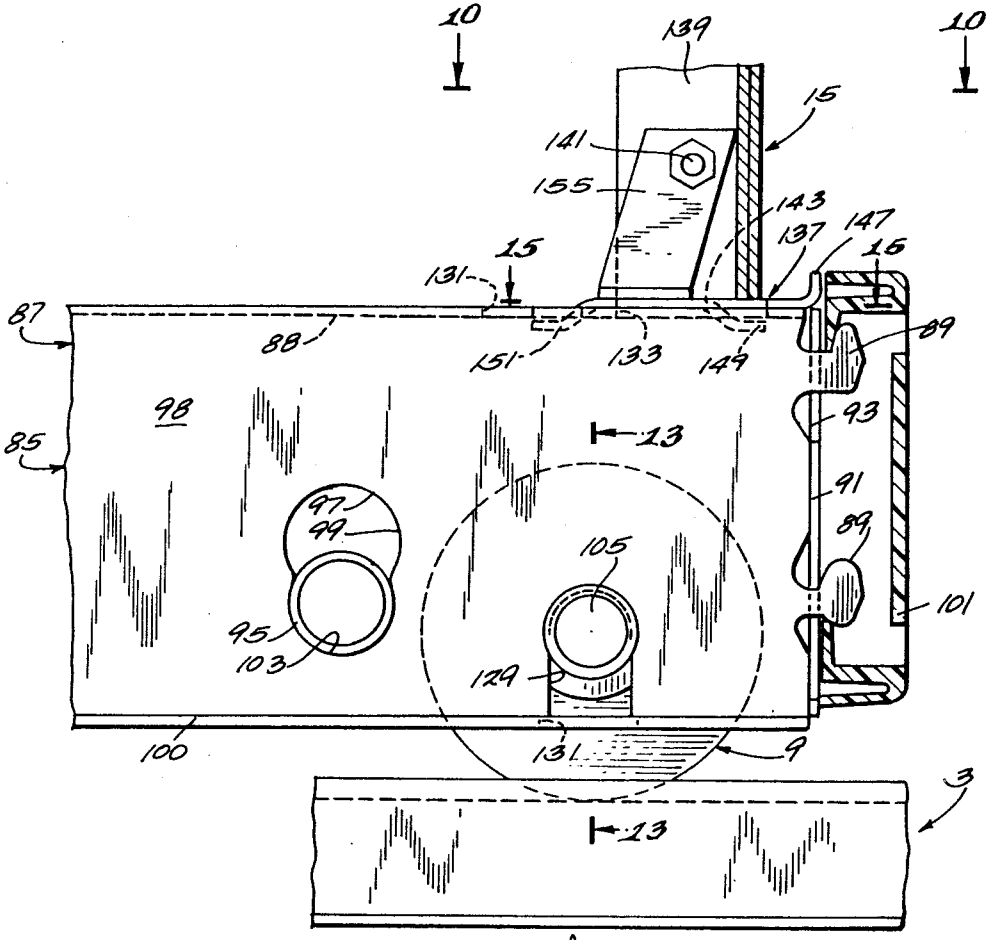
FIG. 8 is a partially broken side view of a portion of the carriage platform of the present invention.
Figure 11:
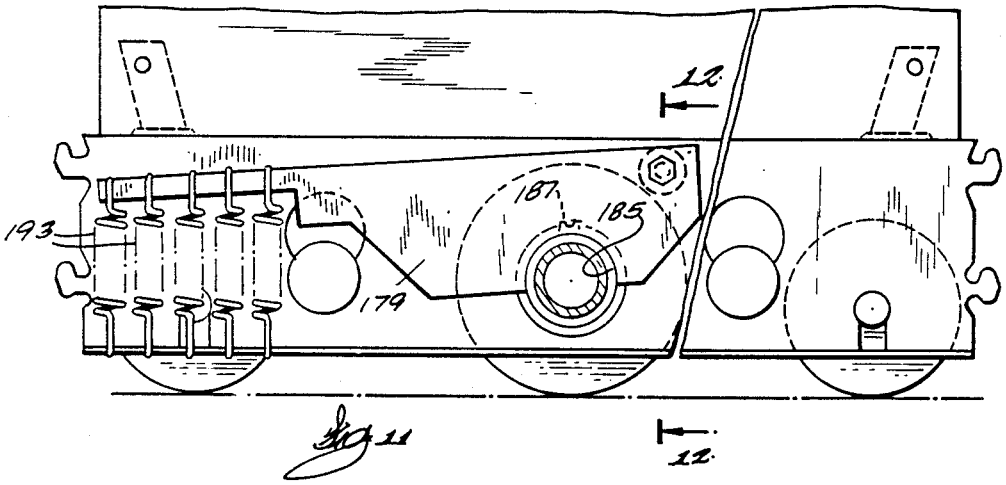
FIG. 11 is a side view of a portion of a mechanical assist for the mobile carriage.
Figure 12:
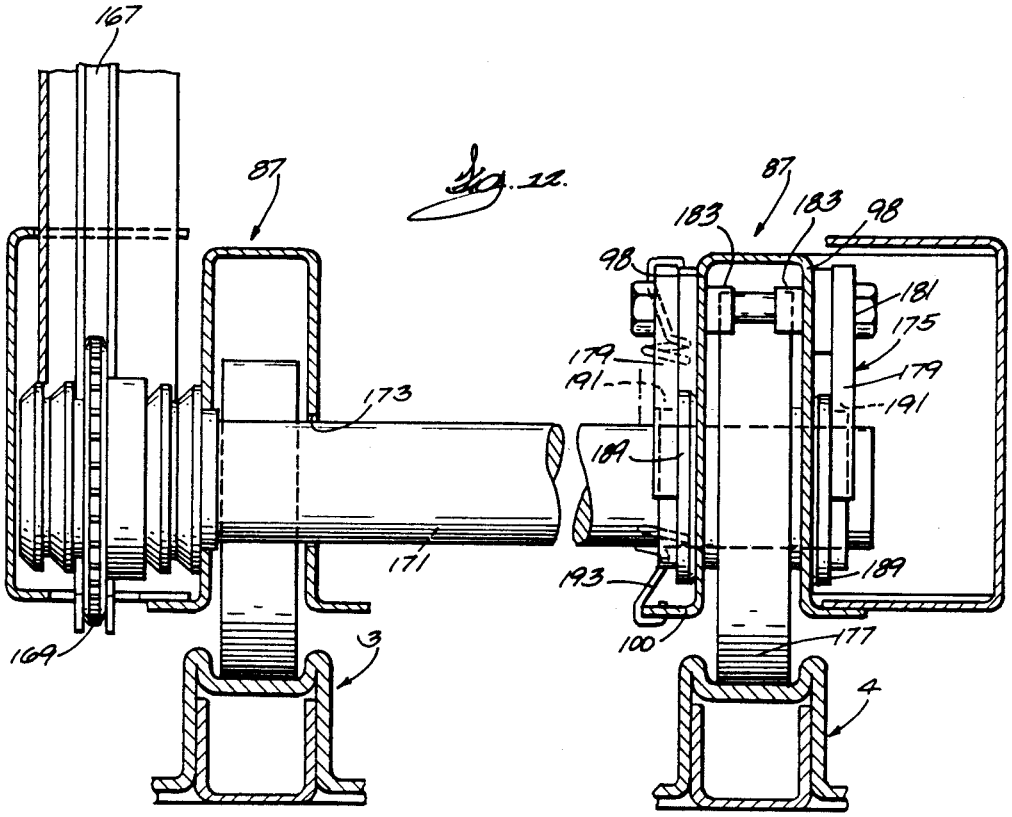
FIG. 12 is a cross-sectional view taken along lines 12—12 of FIG. 11.

In accordance with the present invention, the rail sets 3 and 4 are placed in true level condition independent of the surface contour of the floor 5 by stackable and interlockable shims. Looking especially at FIG. 7, a stack of two shims 63, 63*a* is depicted in conjunction with a rail support bracket 25. However, it will be appreciated that more or fewer than two shims may be used in a stack depending on floor surface conditions. Shims 63 and 63*a* are identical, but they are rotated 180° with respect to each other when used.

Shim 63 comprises a generally rectangular base 65 with notches 67 at two of the corners. At the two opposite corners, respective tangs 69 are sheared from the base 65 and bent slightly upwardly therefrom. In the central portion of the base is a rectangular cutout 71 and a third tang 73. The height of the tangs 69 and 73 above the base 65 is no greater than the thickness of the shim base. The notches 67, tangs 69 and 73, and cutout 71 are located symmetrically about the shim longitudinal center line 72 and the transverse center line 74. When a shim 63 is turned 180° relative to and placed over an underlying shim 63*a*, the lower shim tangs 69*a* engage the notches 67, and the central tang 73*a* engages the cutout 71. Simultaneously, tangs 69 engage notches 67*a*, and tang 73 engages cutout 71*a*. As a result, the two shims become interlocked and are unable to slide or rotate relative to each other. If desired, both corner notches 67 may be located on the same side of the longitudinal center line 72, with both tangs 69 being on the opposite side of the longitudinal center line.

Superimposed on the top shim 63 of a stack thereof is a rail support bracket 25. The rail support brackets are designed to interlock with the top shim. For that purpose, the rail support bracket base 27 has a pair of notches 75 and 77 at the outside corners of the respective arms 43 and 59. The notches 75 and 77 are sized and located so as to engage the tangs 69 of an underlying shim. Similarly, the rail support bracket base defines a pair of cutouts 79 for engaging the central tang 73 of the underlying shim. The two sets of rail support bracket notches 75 and 77 and the two central cutouts 79 enable an underlying shim 63 to be in either of two orientations 180° apart and still be able to engage and interlock with the underlying shim. In that manner, the rail support bracket and the stack of shims lying thereunder are held together.

Figure 6:
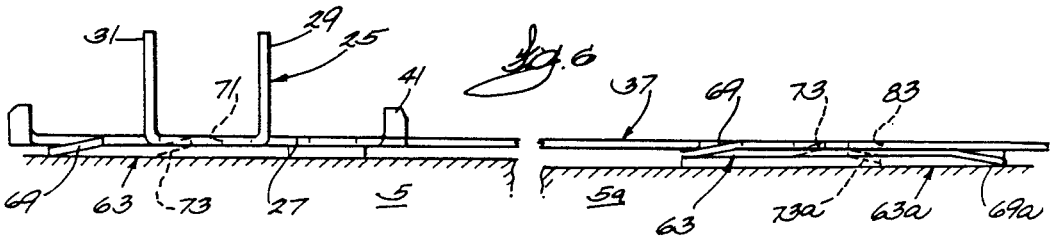
FIG. 6 is a side view of FIG. 5.

The rail sets 3 and 4 are individually leveled by placing the proper number and thickness shims under each rail support bracket 25. As many shims as necessary may be stacked in alternating 180° orientations. In FIG. 6, a single shim is depicted, but more or fewer shims may be used at any particular location. For example, in FIG. 3, the rail support bracket 25 is shown in direct engagement with the floor 5. To reduce the number of shims needed in a stack, they may be made in two or more thicknesses. We have found that two thicknesses, 0.03 inches and 0.13 inches, work very well for providing adjustment flexibility with minimum shim inventory. The interlocking features of the shims and rail support brackets greatly simplifies rail alignment, because the shims at one rail support bracket do not slip and slide about as subsequent stacks of shims are installed and adjusted under other rail support brackets.

It is a feature of the present invention that the shims 63 are also used to level the rail spreaders 37. Such leveling is highly desirable, because the floor panels 45 rest on the rail spreaders, FIGS. 3 and 4. Looking especially at FIGS. 5 and 6, a floor 5 is shown that has a low spot 5a under the mid-section of a rail spreader. To accommodate the particular floor contour illustrated, two shims 63 and 63a are necessary. The shims also interlock with the rail spreader. Such interlocking is achieved by notching the spreaders at 81 in a manner such that the respective tangs 69 of the underlying shim can engage the notches. Similarly, cutouts 83 are formed in the spreaders for engaging the central tang 73 of a shim. As with the shims stacked under the rail support brackets 25, the interlocking feature of the shims with each other and with the rail spreader greatly facilitates alignment of the rail spreaders and contributes to the modular and inexpensive construction of the present invention.

The carriages 7 are supported on the rail sets 3 and 4 by respective modular platforms 85. Turning to FIGS. 8, 9, 11, and 12, the platform 85 comprises a pair of platform bearing sections 87, each of which is parallel to and generally overlying a rail set 3 or 4. Each bearing section 85 is preferably made as a generally u-shaped channel having a top wall 88 and spaced parallel side walls 98. The free ends of the side walls 98 terminate in respective outturned feet 100. The ends of one of the bearing section side walls are provided with vertically aligned tabs 89. The other side wall has end tabs 90. Side panels 91 have slots 93 therein suitable for receiving the bearing section tabs 89. Two side panels 91 are locked to the opposite ends of each of the two bearing sections by means of the tabs 89 such that the side panels run transverse to the rail sections and cooperate with the bearing sections to create a four-sided platform.

A front cover 92 conceals each bearing section 87. Each front cover 92 comprises an elongated generally u-shaped member 86 with end plates 94. The end plates 94 are notched at 96 to engage the bearing section tabs 90, thereby enabling the front covers to be assembled to and supported by the respective bearing sections. A decorative bumper clip 101 is installed over the bearing section tabs 89 and 90 and over the joint between the ends of the side panels and the front panels on each end of the platform. The bumper clips 101 create a neat appearance while also serving to cushion the carriage should it strike an adjacent carriage or a stationary unit while rolling along the rail sets.

To provide structural rigidity to the platform 85, a pair of structural tubes 95 are employed. The structural tubes 95 are pressed into respective portions 103 of an inverted generally FIG. 8 shaped hole 97. At the initial stages of assembly, the structural tubes are placed loosely within the larger openings 99 of the FIG. 8 hole 97; at a later state, the structural tubes are pressed into a tight fitting assembly with the smaller portion 103.

Further in accordance with the present invention, the carriage platform 85 is rollingly supported on the rail sets 3 and 4 by a series of heavy duty but inexpensive wheel assemblies 9. Looking especially at FIGS. 8, 13, and 14, each wheel assembly 9 comprises a shaft 105, a bearing 107, a ring 109, and a shell or wheel 111. The shaft 105 has a shoulder 113 that locates the bearing in one direction on the shaft. The ring 109 has an inner diameter with a size-on-size fit with the shaft outer diameter. The ring is placed over the shaft and against the bearing inner race. Then the ring material around the inner diameter thereof is swaged into the shaft, such that a portion 115 of the ring material penetrates the periphery of the shaft. In that manner, the bearing is retained in both directions on the shaft. The wheel 111 is located and retained on the bearing outer race in one direction by a wheel shoulder 117. To retain the wheel on the bearing in the second direction, the wheel face opposite the shoulder 117 is manufactured with an annular groove, such as the v-shaped groove 119 shown. The groove 119 is located such that a narrow band of material 121 is adjacent the bearing outer race. Several short portions 123 of the band of material are then swaged over the bearing outer race to thereby retain the wheel on the bearing.

Figure 13:
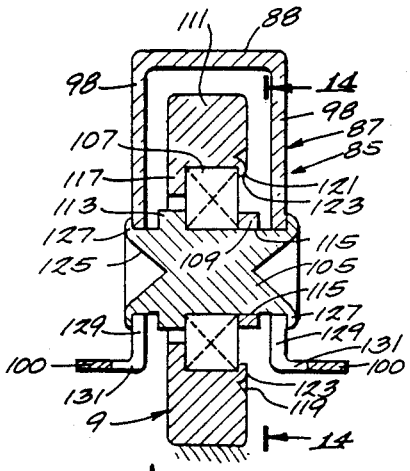
FIG. 13 is a cross-sectional view taken along lines 13—13 of FIG. 8.
Figure 14:
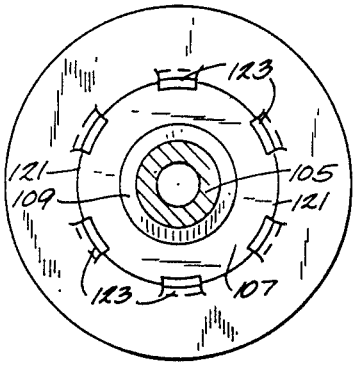
FIG. 14 is a cross-sectional view taken along lines 14—14 of FIG. 13.
Figure 15:
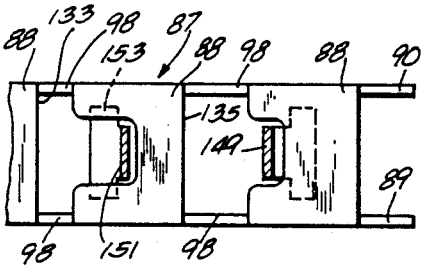
FIG. 15 is a partial view taken along lines 15—15 of FIG. 8.
Figure 10:
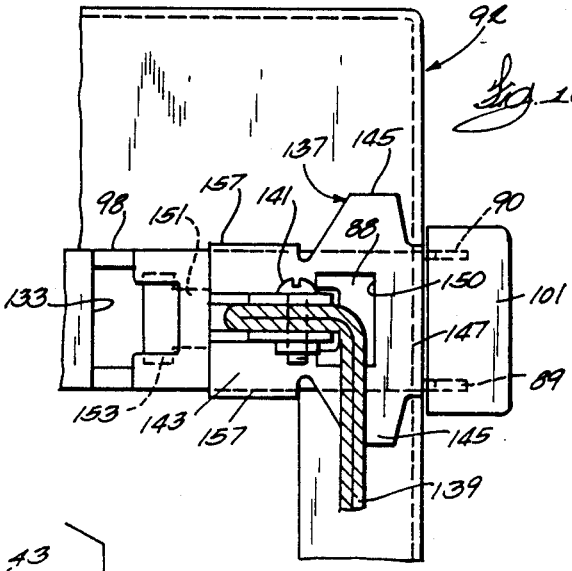
FIG. 10 is a view taken along lines 10—10 of FIG. 8.

In the illustrated construction, the shaft 105 is machined with recesses in the two ends thereof. In FIG. 13, a frusto-conical recess 125 is shown, but other shapes are also possible. The recess 125 is sized and located such that a narrow band 127 of shaft material exists at the two ends of the shaft between the respective recess and the shaft outer diameter. A pair of slots 129 is formed in each platform bearing section side wall 98. The slots 99 terminate in respective radii very slightly larger than the outer diameter of the shaft. Slots 131 that are continuations of the respective slots 129 are formed in the feet 100 of the bearing sections 87.

To rigidly assemble the wheel assemblies 9 to the carriage platform 85 without fasteners, the shafts 105 of the wheel assemblies 9 are pushed into respective bearing section slots 129, such that the shaft ends protrude outside the respective bearing section side walls 98. Then a very large impact force is applied axially to the opposed ends of each shaft. As a result, the narrow bands 127 of material on the ends of each shaft are swaged over onto the respective bearing section side walls. The shafts and thus the entire wheel assemblies are secured in the bearing section side walls in a rigid connection.

A further aspect of the present invention is the means employed to attach the carriage framework 15 to the platform 85. Looking at FIGS. 8–10 and 15, the ends of the top wall 88 of each platform bearing section 87 are fabricated with pairs of t-shaped cutouts 133 and 135. The cutouts 133 and 135 are designed to accept and retain an upright anchor clip 137. In turn, the carriage framework is fastened to the upright anchor clip 137. For example, a portion of a framework post 139 is shown attached to the upright anchor clip by a screw and nut 141.

In the preferred embodiment, the upright anchor clip 137 is fabricated with a base plate 143 having wings 145 extending oppositely therefrom. The base plate 143 front end terminates in a turned up return flange 147. Depending from the base plate is a front lower clip 149. The front lower clip 149 is formed by punching it along contour 150 from the base plate and producing a reverse bend in it. The front lower clip has a generally t-shaped outline. The upright anchor clip is further provided with a back lower clip 151. The back lower clip 151 is formed with a reverse bend, and it has a generally t-shape. Upstanding from the base plate are a pair of parallel lugs 155. The lugs are formed integrally with the base plate by bending the base plate over 180° at 157 and then making 90° bends at 159. The upright anchor clips are assembled to the bearing section top walls by inserting the front lower clips 149 into the cutouts 135 and inserting the back lower clips 151 into the cutouts 133. The upright anchor clips are then slid toward the respective ends of the bearing sections. With the upright anchor clips assembled to the bearing sections, the return flanges 147 positively locate the framework on the platform 85. Pre-drilled in the framework post 139 and in the upright anchor clip lugs 155 make it a simple task to fasten the framework to the platform.

To roll the carriages 7 along the rail sets 3 and 4, the mobile shelving apparatus 1 preferably includes a mechanical assist 11 in conjunction with each carriage. With particular attention to FIGS. 1, 2, 11, and 12, the mechanical assist comprises a hand wheel 161 journaled for rotation within a housing 163 mounted to each carriage. The hand wheel 161 is connected to a sprocket 165 that drives a chain 167. A second sprocket 169 is fastened to a long shaft 171. The shaft 171 passes through clearance holes 173 in the two platform bearing sections 87. Chain adjustment means 175 is used to set the tension of the chain 167.

A tension device 175 comprises a friction wheel 177 mounted to the shift 171 between the side walls 98 of one of the bearing sections 87. A pair of torque arms 179 are pivotally connected to the bearing section side walls adjacent the friction wheel 177 by a screw and nut arrangement 181, together with spacer bushings 183. The torque arms 179 have respective generally semi-circular cutouts 185 with keyways 187. The cutouts 185 and keyways 187 receive respective bearings 189 having keys 191 molded integrally therewith. To the free end of each torque arm are hooked a series of tension springs 193. The second ends of the springs 193 are hooked to a bearing section foot 100. The torque arms, springs, and friction wheels 177 are designed to enable a person applying torque to the hand wheel 161 to move the carriage 7 under normal conditions. However, the wheels 171 are designed to slip if the applied torque exceeds a predetermined amount, as, for example, when attempting a rapid start up or moving two carriages at a time.

Thus, it is apparent that there has been provided, in accordance with the invention, mobile shelving apparatus that fully satisfies the objects, aims, and advantages set forth above. While the invention has been described in conjunction with specific embodiments thereof, it is evident that many alternative, modifications, and variations will be apparent to those skilled in the art in light of the foregoing description. Accordingly, it is intended to embrace all such alternatives, modifications, and variations as fall within the spirit and broad scope of the appended claims.

We claim:

1. Mobile shelving apparatus comprising:

a. carriage means for storing selected items;

b. wheel means for supporting the carriage means for rolling motion; and c. at least two sets of rails placed on a building floor for supporting and guiding the wheel means thereon, each set of rails comprising:

i. a plurality of rails placed in endwise abutment to thereby create joints between adjacent rails;

ii. rail support means for underlying the joints between adjacent abutting rails and for fastening the rails thereto; and iii. shim means for underlying the rail support means and for interlocking therewith to enable the rails to be leveled along the builidng floor, wherein the rail support means comprises a plurality of rail support brackets, each rail support bracket having a flat base with a central portion that defines at least one opening therethrough, at least one arm extending from the base central portion, the arm defining a notch in at least one outside corner thereof, the base central portion opening and the arm notch cooperating with the underlying shim means to interlock therewith.

2. The mobile shelving apparatus of claim 1 wherein:

a. the arm of each rail support bracket is formed with at least one tab upstanding therefrom: and b. the rail sets further comprise:

i. spreader means for cooperating with the rail support brackets to accurately space the rails in each set relative to each other; and ii. shim means for underlying the spreader means to interlock therewith and facilitate leveling the spreader means on the building floor.

3. The mobile shelving apparatus of claim 2 wherein the spreader means comprises at least one elongated rail spreader extending between the sets of rails, the ends of the rail spreader being formed with respective openings that engage the upstanding tab of a respective rail spreader bracket associated with the sets of rails to thereby transversely space the rails, the interior of the rail spreader defining notch and opening means for engaging the shim means to thereby interlock therewith.

4. Mobile shelving apparatus comprising:

a. carriage means for storing selected items;

b. wheel means for supporting the carriage means for rolling motion; and c. at least two sets of rails placed on a building floor for supporting and guiding the wheel means thereon, each set of rails comprising:

i. a plurality of rails placed in endwise abutment to thereby create joints between adjacent rails;

ii. rail support means for underlying the joints between adjacent abutting rails and for fastening the rails thereto; and iii. shim means for underlying the rail support means and for interlocking therewith to enable the rails to be leveled along the building floor, wherein the shim means comprises first and second shims, each shim having a generally rectangular flat base with a central portion and first and second opposed ends, a notch being formed in at least one corner of the first end, at least one first tang protruding above the base and located in a corner of the second end, the base central portion defining an opening therethrough, and a second tang protruding above the base and located in the central portion, the notches, tangs, and central portion opening being sized and located such that one shim may be turned 180° relative to the other shim and placed on top thereof with the first tang of the underlying shim engaging the corner notch of the overlying shim and the second tang of the underlying shim engaging the central portion opening of the overlying shim to interlock the shims to each other, and the tangs of the overlying shim engage the rail support means for interlocking therewith.

5. The mobile shelving apparatus of claim 4 wherein:

a. each shim has a notch formed in both corners of the respective shims first ends; and b. each shim has a first tang protruding above the base in both corners of the respective second ends thereof.

6. The mobile shelving apparatus of claim 4 wherein the rail support means comprises a plurality of rail support brackets, each rail support bracket having a flat base with a central portion that defines a pair of openings therethrough and at least one pair of arms extending oppositely from the central portion, the arms having respective outside corners with a notch being formed in at least one outside corner of each arm, the base central portion openings and the corner notches being sized and located so as to enable the underlying shim to be placed in random 180° orientations relative to the rail support bracket with the underlying shim second tang engaging one of the rail support bracket central portion openings and the underlying shim first tang engaging one of the rail support bracket corner notches.

7. The mobile shelving apparatus of claim 4 wherein:

a. the first and second shims have predetermined thicknesses; and b. the first and second tangs of the underlying shim do not extend above the flat base thereof by a distance greater than the thickness of the overlying shim.

8. Mobile shelving apparatus comprising:

a. carriage means for storing selected items;

b. wheel means for supporting the carriage means for rolling action; and c. at least two sets of rails placed on a building floor for supporting and guiding the wheel means thereon, each set of rails comprising:

i. a plurality of rails placed in endwise abutment to thereby create joints between adjacent rails;

ii. rail support means for underlying the joints between adjacent abutting rails and for fastening the rails thereto; and iii. shim means for underlying the rail support means and for interlocking therewith to enable the rails to be leveled along the building floor, wherein the shim means comprises at least one shim having a generally rectangular base with a central portion and first and second opposed ends, a notch being formed in at least one corner of the first end and at least one first tang protruding above the base and located in a corner of the second end, the base central portion defining an opening therethrough, and a second tang protruding above the base central portion, the first and second tangs being sized and located to cooperate with the overlying rail support means to interlock therewith.

9. The mobile shelving apparatus of claim 8 wherein:

a. there is a notch in both corners of the respective shims first ends; and b. there is a first tang in both corners of the respective shims second ends.

10. Mobile shelving apparatus comprising:

a. carriage means for storing selected items, wherein the carriage means comprises a platform having a pair of spaced bearing sections, each bearing section being formed as an elongated generally u-shaped channel having spaced side walls;

b. wheel means for supporting the carriage means for rolling motion, wherein the wheel means comprises:

i. at least one shaft assembled to each bearing section, the shaft having opposed ends that extend outside of the bearing section side walls and that have narrow bands of material swaged over the respective side walls of the bearing section to secure the shaft to the bearing section;

ii. a bearing having an inner race mounted on the shaft and an outer race;

iii. a ring placed over the shaft and against the bearing inner race, the ring being swaged onto the shaft to thereby retain the ring and bearing on the shaft; and iv. a wheel mounted to the bearing outer race, the wheel being manufactured with a band of material adjacent the bearing outer race, at least a portion of the band of material being swaged over onto the bearing outer race to thereby retain the wheel on the bearing; and c. at least two sets of rails placed on a building floor for supporting and guiding the wheel means thereon, each set of rails comprising:

i. a plurality of rails placed in endwise abutment to thereby create joints between adjacent rails;

ii. rail support means for underlying the joints between adjacent abutting rails and for fastening the rails thereto; and iii. shim means for underlying the rail support means and for interlocking therewith to enable the rails to be leveled along the building floor.

11. Mobile shelving apparatus comprising:

a. carriage means for storing selected items;

b. wheel means for supporting the carriage means for rolling motion;

c. at least two sets of rails placed on a building floor for supporting and guiding the wheel means thereon, each set of rails comprising:

i. a plurality of rails placed in endwise abutment to thereby create joints between adjacent rails;

ii. rail support means for underlying the joints between adjacent abutting rails and for fastening the rails thereto; and iii. shim means for underlying the rail support means and for interlocking therewith to enable the rails to be leveled along the building floor;

d. platform bearing section associated with each set of rails and comprising a portion of the carriage means; and e. a pair of upright anchor clips assembled in each bearing section, each upright anchor clip having a base plate, a front lower clip, a back lower clip, and a pair of upstanding lugs, the lugs being formed integrally with the base plate and including respective 180° bends that overlie the base plate and respective 90° bends that extend upwardly from the base plate.

12. Apparatus for movingly storing selected items comprising:

a. at least two spaced and parallel rail sets, each rail set comprising at least two rails placed in endwise abutting contact;

b. bracket means for joining adjacent abutting rails of each rail set to each other;

c. shim means for underlying the bracket means and interlocking therewith to level the rail sets along a building floor, wherein the bracket means comprises a plurality of rail support brackets, each rail support bracket having a flat base with a central portion that defines at least one opening therethrough, and at least one arm extending from the base central portion, the arm defining a notch in at least one outside corner thereof, the base central portion opening and the arm notch cooperating with the underlying shim means to interlock therewith; and d. carriage means for rolling along the rail sets and for holding the selective items.

13. The apparatus of claim 12 wherein the shim means comprises first and second shims, each shim having a generally rectangular flat base with a central portion and first and second opposed ends, a notch being formed in at least one corner of the first end, at least one first tang protruding above the base and located in a corner of the second end, the base central portion defining an opening therethrough, and a second tang protruding above the base and located in the central portion, the notches, tangs, and central portion opening being sized and located such that one shim may be turned 180° relative to the other shim and placed on top thereof with the first tang of the underlying shim engaging the corner notch of the overlying shim and the second tang of the underlying shim engaging the central portion opening of the overlying shim to interlock the shims to each other, and the tangs of the overlying shim engaging the notch in the rail support bracket arm and the opening in the rail support bracket central portion to thereby interlock the shims with the rail support bracket.

14. The apparatus of claim 13 wherein:

a. each shim has a notch formed in both corners of the respective shims first ends;

b. each shim has a first tang protruding above the base in both corners of the respective second ends thereof; and c. the rail support brackets have notches in both outside corners of the arm thereof that engage the tangs on the corners of the underlying shim.

15. The apparatus of claim 12 further comprising:

a. a rail spreader located between the rail sets to accurately space the rail sets relative to each other, the rail spreader having ends that are retained by the rail support bracket associated with the respective rail sets, the central portions of the respective rail spreaders having at least one opening therethrough and at least one notch; and b. at least one shim having a generally rectangular base with a central portion and first and second opposed ends, a notch being formed in at least one corner of the first end and at least one first tang protruding above the base and located in a corner of the second end, the base central portion defining an opening therethrough, and a second tang protruding above the base central portion, the first and second tangs being sized and located to engage the opening and notch, respectively, in the rail spreader and cooperate therewith to interlock the shim with the rail spreader.

16. Apparatus for movingly storing selected items comprising:

a. at least two spaced and parallel rail sets, each rail set comprising at least two rails placed in endwise abutting contact;

b. bracket means for joining adjacent abutting rails of each rail set to each other;

c. shim means for underlying the bracket means and interlocking therewith to level the rail sets along a building floor, wherein the shim means comprises at least one shim having a generally rectangular base with a central portion and first and second opposed ends, a notch being formed in at least one corner of the first end and at least one first tang protruding above the base and located in a corner of the second end, the base central portion defining an opening therethrough, and a second tang protruding above the base central portion, the first and second tangs being sized and located to cooperate with the overlying bracket means to interlock therewith; and d. carriage means for rolling along the rail sets and for holding the selective items.

17. The apparatus of claim 16 wherein:

a. there is a notch in both corners of the respect shim first ends; and b. there is a first tang in both corners of the respective shims second ends.

18. Apparatus for movingly storing selected items comprising:

a. at least two spaced and parallel rail sets, each rail set comprising at least two rails in endwise abutting contact;

b. bracket means for joining adjacent abutting rails of each rail set to each other;

c. shim means for underlying the bracket means and interlocking therewith to level the rail sets along a building floor; and d. carriage means for rolling along the rail sets and for holding the selected items, wherein the carriage means comprises:

i. a platform bearing section located over each of the rail sets, each platform bearing section being generally u-shaped with spaced sidewalls;

ii. at least one shaft having opposite ends that are swaged over the respective side walls of each bearing section to thereby secure the shafts to the bearing sections; and iii. wheel means rotatably mounted to each shaft and in contact with a rail set to thereby rollingly support the carriage means on the rail sets, wherein the wheel means comprises;

a bearing having an outer race and an inner race mounted on the shaft and positively retained on one side thereof by the shaft;

a ring mounted on the shaft against the other side of the bearing race, the ring material adjacent the shaft being swaged into the shaft to thereby positively retain the bearing inner race on the other side thereof; and a wheel mounted to the bearing outer race and having a shoulder on one side thereof for positively retaining the wheel on one side of the bearing outer race, the wheel being machined on the second side thereof with an annular band of material adjacent the bearing outer race, at least a part of the annular band of material being swaged over onto the bearing outer race to thereby positively retain the wheel on the other side of the bearing outer race.

19. Apparatus for movingly storing selected items comprising:

a. at least two spaced and parallel rail sets, each rail set comprising at least two rails placed in endwise abutting contact;

b. bracket means for joining adjacent abutting rails of each rail set to each other;

c. shim means for underlying the bracket means and interlocking therewith to level the rail sets along a building floor; and d. carriage means for rolling along the rail sets and for holding the selective items, wherein the carriage means comprises:

i. a platform bearing section located over each of the rail sets, each platform bearing section being generally u-shaped with spaced side walls;

ii. frame means supported by the bearing sections for holding the selected items to be stored; and iii. a plurality of upright anchor clips for attaching the frame means to the bearing sections, each upright anchor clip comprising:

a base plate;

a pair of clips integrally joined to the base plate and depending therefrom to assemble with the bearing section;

a return flange upstanding from the base plate for guiding the frame means thereon; and a pair of spaced lugs upstanding from the base plate, the lugs being formed integrally with the base plate and having 180° return bends overlying the base plate and 90° bends such that the lugs extend upright from the base plate, the frame means being located by the return flanges and attached to the upright lugs.

* * * * *